US010700444B2

(12) United States Patent
Chou et al.

(10) Patent No.: US 10,700,444 B2
(45) Date of Patent: Jun. 30, 2020

(54) MULTI-BEAM PHASED ANTENNA STRUCTURE AND CONTROLLING METHOD THEREOF

(71) Applicant: INDUSTRIAL TECHNOLOGY RESEARCH INSTITUTE, Hsinchu (TW)

(72) Inventors: Hsi-Tseng Chou, Taipei (TW); Kevin Chen, New Taipei (TW); Ying-Shan Chen, Taoyuan (TW)

(73) Assignee: INDUSTRIAL TECHNOLOGY RESEARCH INSTITUTE, Hsinchu (TW)

( * ) Notice: Subject to any disclaimer, the term of this patent is extended or adjusted under 35 U.S.C. 154(b) by 550 days.

(21) Appl. No.: 15/389,910

(22) Filed: Dec. 23, 2016

(65) Prior Publication Data

US 2018/0013192 A1 Jan. 11, 2018

Related U.S. Application Data

(60) Provisional application No. 62/358,597, filed on Jul. 6, 2016.

(51) Int. Cl.
*H01Q 25/00* (2006.01)
*H01Q 1/24* (2006.01)
(Continued)

(52) U.S. Cl.
CPC ..... *H01Q 25/005* (2013.01); *H01Q 1/246* (2013.01); *H01Q 3/36* (2013.01); *H01Q 3/40* (2013.01); *H01Q 21/22* (2013.01)

(58) Field of Classification Search
CPC .... H01Q 25/005; H01Q 21/22; H01Q 21/293; H01Q 3/2635; H01Q 3/3641; H01Q 3/40; H01Q 1/246
(Continued)

(56) References Cited

U.S. PATENT DOCUMENTS 3,731,316 A * 5/1973 Sheleg ..... H01Q 3/40 342/373
3,811,129 A 5/1974 Holst
(Continued)

FOREIGN PATENT DOCUMENTS

CN 201845860 U 5/2011
CN 103985970 A 8/2014
(Continued)

OTHER PUBLICATIONS

F.Y. Zulkifli et al., Sidelobe level suppression using unequal four-way power divider for proximity coupled microstrip antenna, 2013 Asia-Pacific Microwave Conference Proceedings (APMC), 2013 (Year: 2013).*
(Continued)

*Primary Examiner* — Bernarr E Gregory
*Assistant Examiner* — Fred H Mull
(74) *Attorney, Agent, or Firm* — Birch, Stewart, Kolasch & Birch, LLP

(57) ABSTRACT

A multi-beam phased antenna structure and a controlling method are provided. The multi-beam phased antenna structure includes a main antenna array and a passive beam forming circuit. The main antenna array includes a plurality of first main antennas and a plurality of second main antennas. The first main antennas are spaced out a predetermined distance. The predetermined distance is related to a coverage of the multi-beam phased antenna structure. The first main antennas and the second main antennas are interleaved. The second main antennas are spaced out the predetermined distance. The passive beam forming circuit includes a plurality of main phase shifters. The main phase shifters are electrically coupled to the second main antennas, such that a difference between a first phase of each of the
(Continued)

first main antennas and a second phase of each of the second main antennas is substantially 180°.

19 Claims, 3 Drawing Sheets

(51) Int. Cl.
*H01Q 3/36* (2006.01)
*H01Q 3/40* (2006.01)
*H01Q 21/22* (2006.01)

(58) Field of Classification Search
USPC ..... 455/562.1
See application file for complete search history.

(56) References Cited

U.S. PATENT DOCUMENTS

| | | | | |
|---|---|---|---|---|
| 4,045,800 | A * | 8/1977 | Tang | H01Q 3/34 342/372 |
| 4,259,674 | A | 3/1981 | Dragone et al. | |
| 4,642,645 | A | 2/1987 | Haupt | |
| 6,252,560 | B1 * | 6/2001 | Tanaka | H01Q 3/40 342/371 |
| 6,496,158 | B1 | 12/2002 | Ksienski et al. | |
| 7,034,753 | B1 | 4/2006 | Elsallal et al. | |
| 7,265,713 | B2 | 9/2007 | Lewis | |
| 7,887,486 | B2 | 2/2011 | Ustuner et al. | |
| 9,831,906 | B1 * | 11/2017 | Xie | H04B 1/40 |
| 2010/0260076 | A1 | 10/2010 | Corman et al. | |
| 2012/0280861 | A1 * | 11/2012 | Kishimoto | H01Q 3/2611 342/368 |
| 2013/0088391 | A1 * | 4/2013 | Corman | H01Q 21/22 342/365 |
| 2013/0278460 | A1 * | 10/2013 | Ai | H01Q 3/40 342/372 |
| 2017/0301990 | A1 * | 10/2017 | Zhao | H01Q 3/40 |
| 2018/0138592 | A1 * | 5/2018 | Derneryd | H01Q 3/40 |

FOREIGN PATENT DOCUMENTS

| | | | |
|---|---|---|---|
| CN | 103052084 | B | 5/2015 |
| TW | I245454 | B | 12/2005 |
| TW | M335029 | U | 6/2008 |
| TW | M368200 | U | 11/2009 |
| TW | M416217 | U | 11/2011 |
| TW | I369813 | B | 8/2012 |
| TW | M465678 | U | 11/2013 |
| TW | I460923 | B | 11/2014 |
| TW | I505563 | B | 10/2015 |
| TW | I517499 | B | 1/2016 |
| WO | WO 2011/095896 | A | 8/2011 |

OTHER PUBLICATIONS

Akhoondzadeh-Asl et al., "A Novel Low-Profile Monopole Antenna With Beam Switching Capabilities," IEEE Transactions on Antennas and Propagation, vol. 62, No. 3, Mar. 2014 (published Feb. 27, 2014, first published Dec. 17, 2013), pp. 1212-1220.

Blanco et al., "On the Use of Leaky Wave Phased Arrays for the Reduction of the Grating Lobe Level," IEEE Transactions on Antennas and Propagation, vol. 62, No. 4, Apr. 3, 2014 (first published Jul. 10, 2013), pp. 1789-1795.

Chen et al., "A beam-switching tapered slot antenna array with an 8×8 Butler matrix," IEEE International Symposium on Antennas and Propagation & USNC/URSI National Radio Science Meeting, 2015, pp. 2481-2482.

Cheng et al., "Millimeter-Wave Miniaturized Substrate Integrated Multibeam Antenna," IEEE Transactions on Antennas and Propagation, vol. 59, No. 12, Dec. 2011, pp. 4840-4844.

Chou, "An Effective Design Procedure of Multibeam Phased Array Antennas for the Applications of Multisatellite/Coverage Communications," IEEE Transactions on Antennas and Propagation, vol. 64, No. 10, Oct. 4, 2016 (first published May 10, 2016), pp. 4218-4227.

Christie et al., "Rotman Lens-Based Retrodirective Array," IEEE Transactions on Antennas and Propagation, vol. 60, No. 3, Mar. 2, 2012, pp. 1343-1351.

Feng et al., "Two-Way Pattern Grating Lobe Control for Distributed Digital Subarray Antennas," IEEE Transactions on Antennas and Propagation, vol. 63, No. 10, Oct. 2, 2015 (first published Aug. 7, 2015), pp. 4375-4383.

Fonseca et al., "Cancellation of Beam Squint with Frequency in Serial Beamforming Network-Fed Linear Array Antennas," IEEE Antennas and Propagation Magazine, vol. 54, No. 1, Feb. 2012, pp. 32-39.

Hakkarainen et al., "Widely-Linear Beamforming and RF Impairment Suppression in Massive Antenna Arrays," Journal of Communications and Netwoks, vol. 15, No. 4, Aug. 2013, pp. 383-397.

Haupt, "Reducing Grating Lobes Due to Subarray Amplitude Tapering," IEEE Transactions on Antennas and Propagation, vol. AP-33, No. 8, Aug. 1985, pp. 846-850.

Hong et al., "Design of a novel planar Butter matrix beamformer with two-axis beam-switching capability," IEEE Microwave Conference Proceedings, vol. 5, 2005, pp. 1-4.

Lee et al., "Multi-layer beamforming lens antenna array with a new line design for millimeter-wave system-in-package applications," IEEE Proceedings of the 5th European Conference on Antennas and Propagation (EUCAP), 2011, pp. 2954-2958.

Li et al., "60-GHz Dual-Polarized Two-Dimensional Switch-Beam Wideband Antenna Array of Magneto-Electric Dipoles," IEEE Transactions on Antennas and Propagation, vol. 64, Issue 2, 2015, pp. 1542-1543.

Mailloux et al., "An Array Technique with Grating-Lobe Suppression for Limited-Scan Applications," IEEE Transactions on Antennas and Propagation, vol. AP-21, No. 5, Sep. 1973, pp. 597-602.

Pavithra et al., "Design of microstrip patch array antenna using beamforming technique for ISM Band," IEEE Fifth International Conference on Advanced Computing (ICoAC), 2013, pp. 504-507.

Pham et al., "Microstrip antenna array with beamforming network for WLAN applications," IEEE Antennas and Propagation Society International Symposium, 2005, pp. 267-270.

Wheeler, "The Grating-Lobe Series for the Impedance Variation Antenna in a Planar Phased-Array," IEEE Transactions on Antennas and Propagation, vol. AP-14, No. 6, Nov. 1966, pp. 707-714.

* cited by examiner

MULTI-BEAM PHASED ANTENNA STRUCTURE AND CONTROLLING METHOD THEREOF

This application claims the benefit of U.S. provisional application Ser. No. 62/358,597, filed Jul. 6, 2016, the disclosure of which is incorporated by reference herein in its entirety.

TECHNICAL FIELD

The disclosure relates in general to a multi-beam phased antenna structure and a controlling method thereof.

BACKGROUND

In mobile communications, it is required to set the radiation coverage of a base-station transceiver system (BTS). The propagation loss is an important issue in the future mmW 5G applications. Therefore, directional beams with high-gain are required to compensate the energy loss. However, the beamwidth of a directional beam is too narrow to provide sufficient coverage. Beam steering or multi-beam coverage is therefore required in the applications, where traditional approaches employ phased array of antennas. Especially for the multiple directional beam radiations, conventional approach requires to use multiple sets of phased array of antennas.

SUMMARY

The disclosure is directed to a multi-beam phased antenna structure and a controlling method thereof.

According to one embodiment, a multi-beam phased antenna structure is provided. The multi-beam phased antenna structure includes a main antenna array and a passive beam forming circuit. The main antenna array includes a plurality of first main antennas and a plurality of second main antennas. The first main antennas are spaced out a predetermined distance. The predetermined distance is related to a coverage of the multi-beam phased antenna structure. The first main antennas and the second main antennas are interleaved. The second main antennas are spaced out the predetermined distance. The passive beam forming circuit includes a plurality of main phase shifters. The main phase shifters are electrically coupled to the second main antennas, such that a difference between a first phase of each of the first main antennas and a second phase of each of the second main antennas is substantially 180°.

According to another embodiment, a multi-beam phased antenna structure is provided. The multi-beam phased antenna structure includes a main antenna array and two auxiliary antenna arrays. The main antenna array includes a plurality of first main antennas and a plurality of second main antennas. The first main antennas and the second main antennas are interleaved. The auxiliary antenna arrays are disposed at two sides of the main antenna array.

According to another embodiment, a controlling method of a multi-beam phased antenna structure is provided. The multi-beam phased antenna structure at least includes a main antenna array. The main antenna array includes a plurality of first main antennas and a plurality of second main antennas. The first main antennas are spaced out a predetermined distance. The predetermined distance is related to a coverage of the multi-beam phased antenna structure. The first main antennas and the second main antennas are interleaved. The second main antennas are spaced out the predetermined distance. The controlling method includes the following steps: A power is provided to the first main antennas and the second main antennas. The power provided to the second main antennas is shifted, such that a difference between a first phase of each of the first main antennas and a second phase of each of the second main antennas is substantially 180°.

Figure 1:
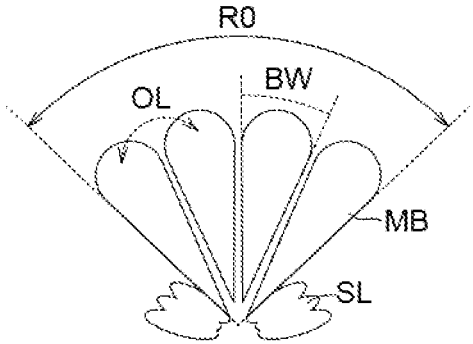
FIG. 1 shows four main beams and several side lobes thereof.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

DETAILED DESCRIPTION

In this disclosure, the number of antenna array is reduced to be one. A multi-beam phased antenna structure is developed to provide multi-input and multi-output ports that are referred to beam and antenna ports, respectively. Here each beam port excitation will result in a set of excitation coefficients to excite the phased array of antennas and radiate a directional beam. This strategy may significantly simplify the antenna structure and retain the minimum size. As a result, multiple beam ports will result in multiple beam radiations which are distributed angularly over the front space for the purpose of coverage or beam steering. In this disclosure, a new design of beam forming circuit is provided to achieve an orthogonal beam overlapping within a relatively arbitrary domain.

Please refer to FIG. 1. FIG. 1 shows four main beams MB and several side lobes SL thereof. In cell planning, there are several targets to be achieved. Firstly, it is needed to form a plurality of main beams MB in a predetermined (sector) coverage R0. Secondly, the beamwidth BW of each of the main beams MB is needed to be adjustable. Thirdly, the overlapping OL between two adjacent main beams MB is needed to be adjustable. Fourthly, the side lopes SL are needed to be inhibited.

Figure 2:
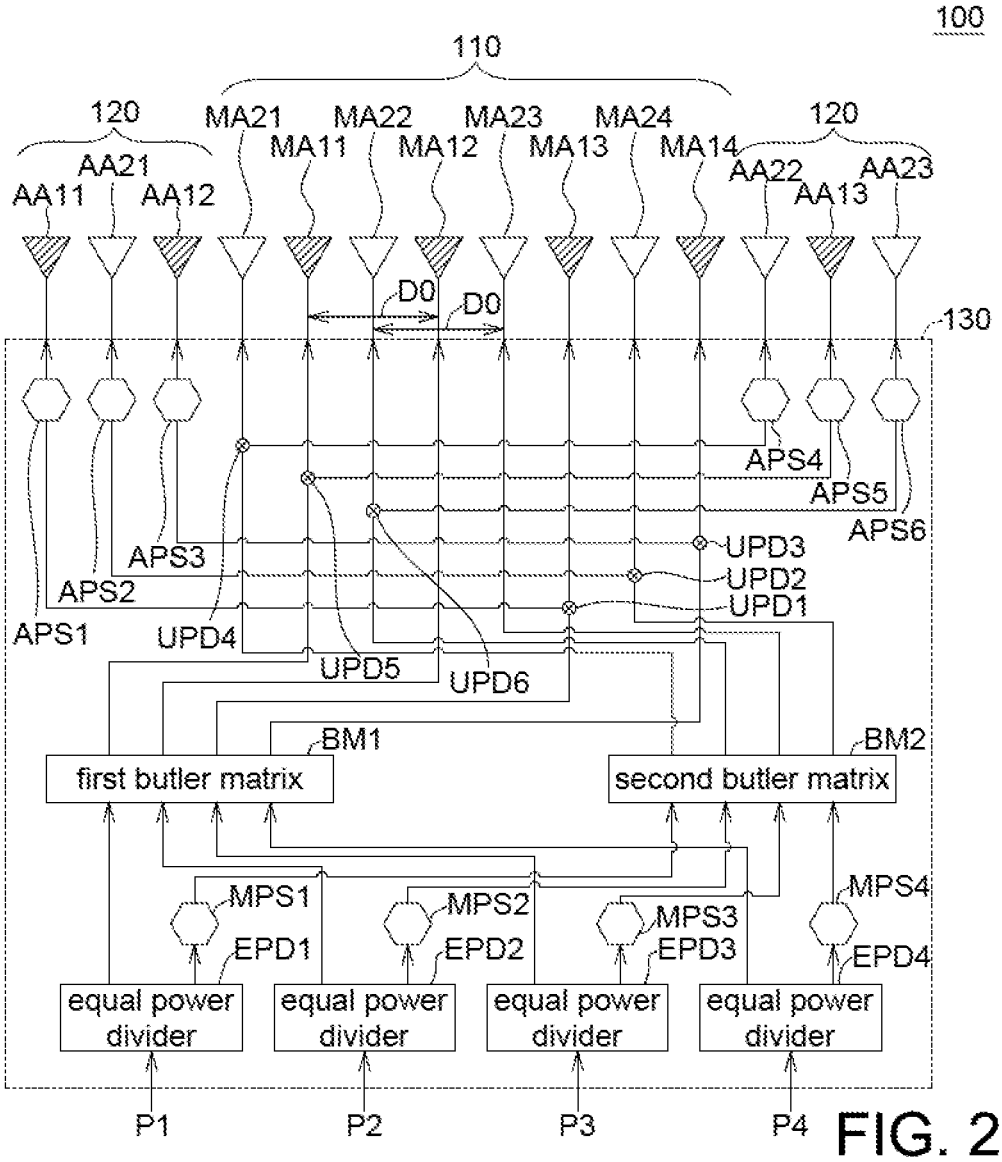
FIG. 2 shows a multi-beam phased antenna structure.

Please refer to FIG. 2. FIG. 2 shows a multi-beam phased antenna structure 100. To achieve the above mentioned targets, the multi-beam phased antenna structure 100 is provided. The multi-beam phased antenna structure 100 includes a main antenna array 110, two auxiliary antenna arrays 120 and a passive beam forming circuit 130. The two auxiliary antenna arrays 120 are disposed at two sides of the main antenna array 110.

The main antenna array 110 includes a plurality of first main antennas MA11, MA12, MA13, MA14 and a plurality of second main antennas MA21, MA22, MA23, MA24. In this embodiment, the quantity of the first main antennas MA11, MA12, MA13, MA14 is equal to the quantity of the second main antennas MA21, MA22, MA23, MA24. The first main antennas MA11, MA12, MA13, MA14 and the second main antennas MA21, MA22, MA23, MA24 are interleaved.

The two auxiliary antenna arrays 120 include a plurality of first auxiliary antennas AA11, AA12, AA13 and a plurality of second auxiliary antennas AA21, AA22, AA23. In this embodiment, the quantity of the first auxiliary antennas AA11, AA12, AA13 is equal to the quantity of the second auxiliary antennas AA21, AA22, AA23. The first auxiliary antennas AA11, AA12, AA13 and the second auxiliary antennas AA21, AA22, AA23 are interleaved.

The passive beam forming circuit 130 includes a plurality of equal power divider EPD1, EPD2, EPD3, EPD4, a plurality of main phase shifters MPS1, MPS2, MPS3, MPS4, a first butler matrix BM1, a second butler matrix BM2, a plurality unequal power divider UPD1, UPD2, UPD3, UPD4, UPD5, UPD6, and a plurality of auxiliary phase shifters APS1, APS2, APS3, APS4, APS5, APSE.

In this embodiment, the first main antennas MA11, MA12, MA13, MA14 are spaced out a predetermined distance D0. The second main antennas MA11, MA12, MA13, MA14 are also spaced out the predetermined distance D0. The predetermined distance D0 is related to the coverage R0 of the multi-beam phased antenna structure 100. For example, if the predetermined distance D0 is increased, the coverage R0 of the multi-beam phased antenna structure 100 will be narrow. Therefore, four main beams MB resulted from the main antenna array 110 can be formed in the predetermined coverage R0 by adjusting the predetermined distance D0.

The main phase shifters MPS1, MPS2, MPS3, MPS4 are electrically coupled to the second main antennas MA21, MA22, MA23, MA24 respectively, such that a difference between a first phase of each of the first main antennas MA11, MA12, MA13, MA14 and a second phase of each of the second main antennas MA21, MA22, MA23, MA24 is substantially 180°. Therefore, the grating lobes formed by the first main antennas MA11, MA12, MA13, MA14 is balanced off the grating lobes formed by the second main antennas MA21, MA22, MA23, MA24.

In the multi-beam phased antenna structure 100, the number of antennas is increased by configuring the two auxiliary antenna arrays 120. If the number of antennas is increased, the beamwidth BW of each of the main beams MB can be decreased and the overlapping OL between two adjacent main beams MB can be decreased. Therefore, the beamwidth BW of each of the main beams MB and the overlapping OL between two adjacent main beams MB can be adjustable by configuring the two auxiliary antenna arrays 120.

Each of equal power dividers EPD1, EPD2, EPD3, EPD4 is electrically coupled to the first butler matrix BM1 and one of the main phase shifters MPS1, MPS2, MPS3, MPS4. That is to say, a power P1 inputted the equal power divider EPD1 is divided into two parts. 50% of the power P1 is outputted to the first butler matrix BM1. 50% of the power P1 is outputted to the main phase shifter MPS1 and then outputted to the second butler matrix BM2. A power P2 inputted the equal power divider EPD2 is divided into two parts. 50% of the power P2 is outputted to the first butler matrix BM1. 50% of the power P2 is outputted to the main phase shifter MPS2 and then outputted to the second butler matrix BM2. A power P3 inputted the equal power divider EPD3 is divided into two parts. 50% of the power P3 is outputted to the first butler matrix BM1. 50% of the power P3 is outputted to the main phase shifter MPS3 and then outputted to the second butler matrix BM2. A power P4 inputted the equal power divider EPD4 is divided into two parts. 50% of the power P4 is outputted to the first butler matrix BM1. 50% of the power P4 is outputted to the main phase shifter MPS4 and then outputted to the second butler matrix BM2.

The first butler matrix BM1 is electrically coupled between the equal power dividers EPD1, EPD2, EPD3, EPD4 and the first main antennas MA11, MA12, MA13, MA14. The second butler matrix BM2 is electrically coupled between the main phase shifters MPS1, MPS2, MPS3, MPS4 and the second main antennas MA21, MA22, MA23, MA24. In this embodiment, the quantity of the first main antennas MA11, MA12, MA13, MA14 is 4, the first butler matrix BM1 is a 4×4 matrix, the quantity of the second main antennas MA21, MA22, MA23, MA24 is 4, and the second butler matrix BM2 is a 4×4 matrix. In one embodiment, the quantity of the first main antennas can be N, the first butler matrix BM1 can be a N×N matrix, the quantity of the second main antennas can be N, and the second butler matrix BM2 can be a N×N matrix.

In the arrangement of the main antenna array 110 and the auxiliary antenna array 120, the first auxiliary antenna AA22 is adjacent to the second main antenna MA14, and the second auxiliary antenna AA12 is adjacent to the first main antenna MA21.

The first auxiliary antenna AA11 is electrically coupled to the first main antenna MA13, the second auxiliary antenna AA21 is electrically coupled to the second main antenna MA24, the first auxiliary antenna AA12 is electrically coupled to the first main antenna MA14, the second auxiliary antenna AA22 is electrically coupled to the second main antenna MA21, the first auxiliary antenna A13 is electrically coupled to the first main antenna MA11, and the second auxiliary antenna AA23 is electrically coupled to the second main antenna MA22.

The auxiliary phase shifters APS1, APS2, APS3, APS4, APS5, APS6 are electrically coupled to the first auxiliary antenna AA11, the second auxiliary antenna AA21, the first auxiliary antenna AA12, the second auxiliary antenna AA22, the first auxiliary antenna AA13, and the second auxiliary antenna AA23 respectively.

The unequal power divider UPD1 is electrically coupled between the first auxiliary antenna AA11 and the first main antenna MA13, the unequal power divider UPD2 is electrically coupled between the second auxiliary antenna AA21 and the second main antenna MA24, the unequal power divider UPD3 is electrically coupled between the first auxiliary antenna AA12 and the first main antenna MA14, the unequal power divider UPD4 is electrically coupled between the second auxiliary antenna AA22 and the second main antenna MA21, the unequal power divider UPD5 is electrically coupled between the first auxiliary antenna AA13 and the first main antenna MA11, the unequal power divider UPD6 is electrically coupled between the second auxiliary antenna AA23 and the second main antenna MA22.

In this embodiment, the unequal power divider UPD1 is a 80%:20% power divider which distributes 80% of the power to the first main antenna MA13 and distributes 20% of the power to the first auxiliary antenna AA11, the unequal power divider UPD2 is a 70%:30% power divider which distributes 70% of the power to the second main antenna MA24 and distributes 30% of the power to the second auxiliary antenna AA21, the unequal power divider UPD3 is a 60%:40% power divider which distributes 60% of the power to the first main antenna MA14 and distributes 40% of the power to the first auxiliary antenna AA12, the unequal power divider UPD4 is a 60%:40% power divider which distributes 60% of the power to the second main antenna MA21 and distributes 40% of the power to the second auxiliary antenna AA22, the unequal power divider UPD5 is a 70%:30% power divider which distributes 70% of the power to the first main antenna MA11 and distributes 30% of the power to the first auxiliary antenna AA13, and the unequal power divider UPD6 is a 80%:20% power divider which distributes 80% of the power to the second main antenna MA22 and distributes 20% of the power to the second auxiliary antenna AA23.

Figure 3:
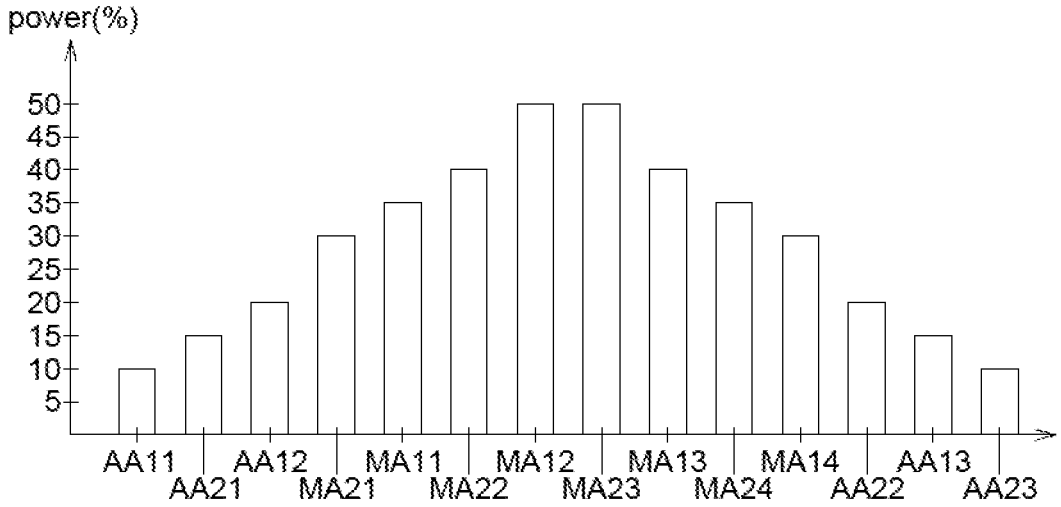
FIG. 3 shows a power distribution of the main antenna array and the auxiliary antenna array.

Please refer to FIG. 3, which shows a power distribution of the main antenna array 110 and the auxiliary antenna array 120. According to the distribution of the unequal power dividers UPD1 to UPD6, the power provided to the first main antennas MA11, MA12, MA13, MA14, the second main antennas MA21, MA22, MA23, MA24, the first auxiliary antennas AA11, AA12, AA13 and the second auxiliary antennas AA21, AA22, AA23 is decreased from a center of the main antenna array 110 to two terminals of the auxiliary antenna arrays 120. That is to say, the main antenna array 110 and the auxiliary antenna arrays 120 have a unimodal symmetric power distribution. Accordingly, the side lopes SL can be inhibited by configuring the unimodal symmetric power distribution.

Figure 4:
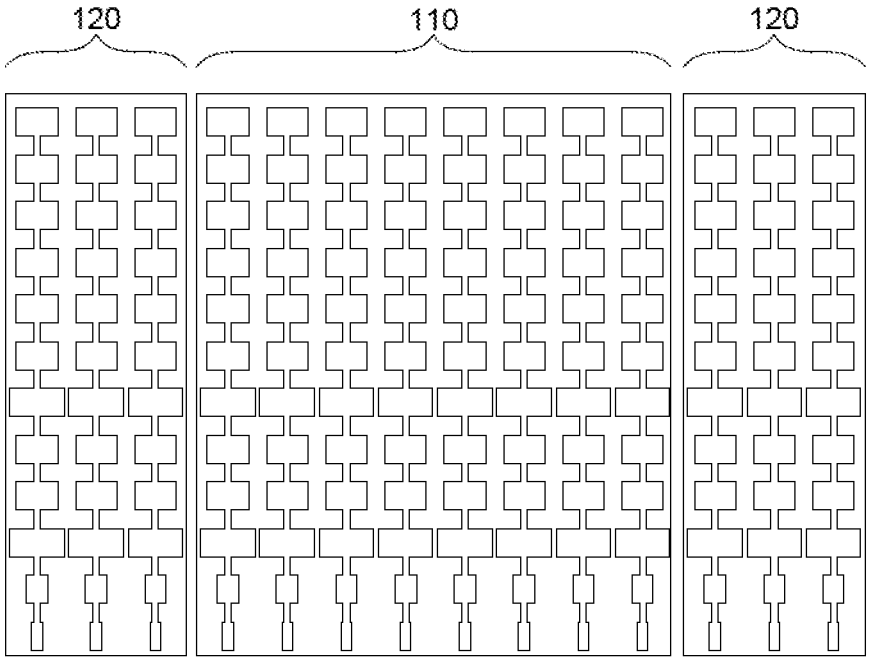
FIG. 4 shows an experimental example of the multi-beam phased antenna structure.

Please refer to FIG. 4, which shows an experimental example of the multi-beam phased antenna structure 100. In this experimental example, the main antenna array 110 is an 8×10 array of microstrip patch antennas, and each of the auxiliary antenna arrays 120 is a 3×10 array of microstrip patch antennas.

Figure 5:
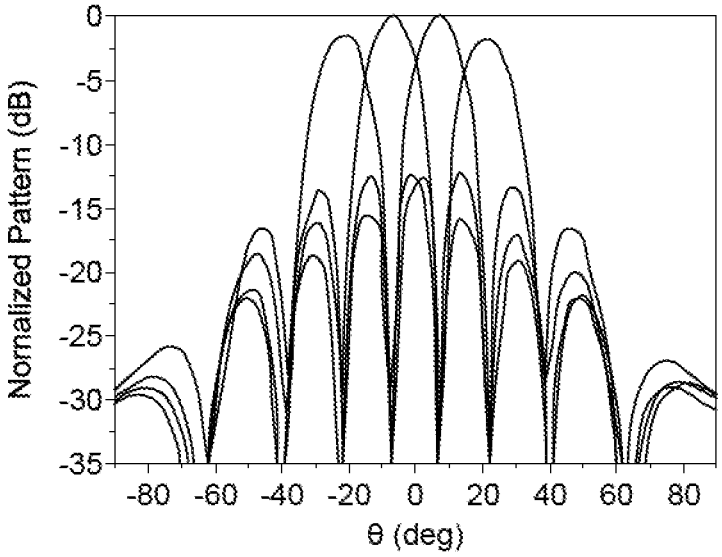
FIG. 5 shows a field pattern distribution of a conventional antenna structure.
Figure 6:
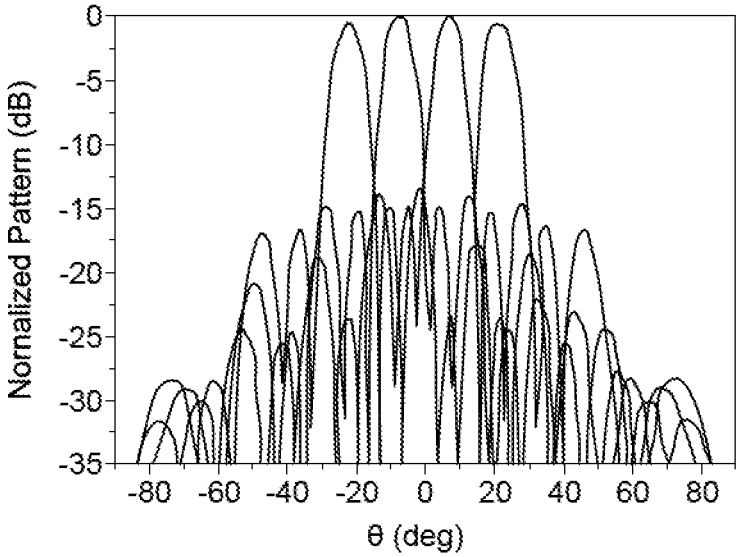
FIG. 6 shows a field pattern distribution of the multi-beam phased antenna structure according to the present disclosure.

Please refer to FIGS. 5 and 6. FIG. 5 shows a field pattern distribution of a conventional antenna structure. FIG. 6 shows a field pattern distribution of the multi-beam phased antenna structure 100 according to the present disclosure. By comparing the FIGS. 5 and 6, the coverage is narrowed from 60° to 40°, the beamwidth is narrowed from 15° to 10°.

Base on above, several main beams MB resulted from the main antenna array 110 can be formed in the predetermined coverage R0 by adjusting the predetermined distance D0. The beamwidth BW of each of the main beams MB and the overlapping OL between two adjacent main beams MB can be adjustable by configuring the two auxiliary antenna arrays 120. The side lopes SL can be inhibited by configuring the unimodal symmetric power distribution.

It will be apparent to those skilled in the art that various modifications and variations can be made to the disclosed embodiments. It is intended that the specification and examples be considered as exemplary only, with a true scope of the disclosure being indicated by the following claims and their equivalents.

What is claimed is:

1. A multi-beam phased antenna structure, comprising:

a main antenna array, including:

a plurality of first main antennas, wherein the first main antennas are spaced out a predetermined distance, and the predetermined distance is related to a coverage of the multi-beam phased antenna structure;

a plurality of second main antennas, wherein the first main antennas and the second main antennas are interleaved, and the second main antennas are spaced out the predetermined distance; and a passive beam forming circuit, including:

a plurality of main phase shifters, wherein a plurality of output ends of all of the main phase shifters are electrically coupled to the second main antennas and are not electrically coupled to the first main antennas, such that a difference between a first phase of each of the first main antennas and a second phase of each of the second main antennas is substantially 180°;

a first butler matrix, electrically coupled to the first main antennas; and a second butler matrix, electrically coupled between the main phase shifters and the second main antennas.

2. The multi-beam phased antenna structure according to claim 1, wherein passive beam forming circuit further includes:

a plurality of equal power dividers, wherein each of the equal power dividers is electrically coupled to the first butler matrix and one of the main phase shifters.

3. The multi-beam phased antenna structure according to claim 1, wherein a quantity of the first main antennas is N, and the first butler matrix is a N×N matrix.

4. The multi-beam phased antenna structure according to claim 1, wherein a quantity of the first main antennas is equal to a quantity of the second main antennas.

5. The multi-beam phased antenna structure according to claim 1, further comprising:

two auxiliary antenna arrays, disposed at two sides of the main antenna array.

6. The multi-beam phased antenna structure according to claim 5, wherein the auxiliary antenna arrays include:

a plurality of first auxiliary antennas; and a plurality of second auxiliary antennas, wherein the first auxiliary antennas and the second auxiliary antennas are interleaved.

7. The multi-beam phased antenna structure according to claim 6, wherein one of the first auxiliary antennas is adjacent to one of the second main antennas, and one of the second auxiliary antennas is adjacent to one of the first main antennas.

8. The multi-beam phased antenna structure according to claim 6, wherein each of the first auxiliary antennas is electrically coupled to one of the first main antennas, and each of the second auxiliary antennas is electrically coupled to one of the second main antennas.

9. The multi-beam phased antenna structure according to claim 6, wherein the passive beam forming circuit further includes:

a plurality of auxiliary phase shifters, electrically coupled to the first auxiliary antennas and the second auxiliary antennas.

10. The multi-beam phased antenna structure according to claim 6, wherein the passive beam forming circuit further includes:

a plurality of unequal power dividers, wherein each of the unequal power dividers is electrically coupled between one of the first auxiliary antennas and one of the first main antennas, or electrically coupled between one of the second auxiliary antennas and one of the second main antennas.

11. The multi-beam phased antenna structure according to claim 10, wherein a power provided to the first main antennas, the second main antennas, the first auxiliary antennas and the second auxiliary antennas is decreased from a center of the main antenna array to two terminals of the auxiliary antenna arrays.

12. A multi-beam phased antenna structure, comprising:

a main antenna array, including:

a plurality of first main antennas; and a plurality of second main antennas, wherein the first main antennas and the second main antennas are interleaved;

two auxiliary antenna arrays, disposed at two sides of the main antenna array, wherein a plurality of unequal power dividers are connected to the main antenna array and the auxiliary antenna arrays, each of the unequal power dividers is connected to the main antenna array and one of the auxiliary antenna arrays; and a passive beam forming circuit, including:

a plurality of main phase shifters;

a first butler matrix, electrically coupled to the first main antennas; and a second butler matrix, electrically coupled between the main phase shifters and the second main antennas.

13. The multi-beam phased antenna structure according to claim 12, wherein the auxiliary antenna arrays include:

a plurality of first auxiliary antennas; and a plurality of second auxiliary antennas, wherein the first auxiliary antennas and the second auxiliary antennas are interleaved.

14. The multi-beam phased antenna structure according to claim 13, wherein one of the first auxiliary antennas is adjacent to one of the second main antennas, and one of the second auxiliary antennas is adjacent to one of the first main antennas.

15. The multi-beam phased antenna structure according to claim 13, wherein each of the first auxiliary antennas is electrically coupled to one of the first main antennas, and each of the second auxiliary antennas is electrically coupled to one of the second main antennas.

16. The multi-beam phased antenna structure according to claim 13, wherein the passive beam forming circuit further comprises:

a plurality of auxiliary phase shifters, electrically coupled to the first auxiliary antennas and the second auxiliary antennas.

17. The multi-beam phased antenna structure according to claim 16, wherein the passive beam forming circuit further includes:

the unequal power dividers, wherein each of the unequal power dividers is electrically coupled between one of the first main antennas and one of the first auxiliary antennas, or electrically coupled between one of the second main antennas and one of the second auxiliary antennas.

18. The multi-beam phased antenna structure according to claim 17, wherein a power provided to the first main antennas, the second main antennas, the first auxiliary antennas and the second auxiliary antennas is decreased from a center of the main antenna array to two terminals of the auxiliary antenna arrays.

19. A controlling method of a multi-beam phased antenna structure, wherein the multi-beam phased antenna structure at least includes a main antenna array and a passive beam forming circuit, the main antenna array includes a plurality of first main antennas and a plurality of second main antennas, the first main antennas are spaced out a predetermined distance, the predetermined distance is related to a coverage of the multi-beam phased antenna structure, the first main antennas and the second main antennas are interleaved, the second main antennas are spaced out the predetermined distance, the passive beam forming circuit includes a plurality of main phase shifters, a first butler matrix, and a second butler matrix, the first butler matrix is electrically coupled to the first main antennas, the second butler matrix is electrically coupled between the main phase shifters and the second main antennas, and the controlling method comprises:

providing a power to the first main antennas and the second main antennas; and shifting the power provided to the second main antennas, such that a difference between a first phase of each of the first main antennas and a second phase of each of the second main antennas is substantially 180°, wherein a plurality of output ends of all of a plurality of main phase shifters are electrically coupled to the second main antennas and are not electrically coupled to the first main antennas.

* * * * *